United States Patent [19]

Brunner

[11] 4,295,745

[45] Oct. 20, 1981

[54] APPARATUS FOR CONDITIONING BIOINJURIOUS WASTE

[75] Inventor: Herbert Brunner, Hanau, Fed. Rep. of Germany

[73] Assignee: Nuken GmbH, Hanau, Fed. Rep. of Germany

[21] Appl. No.: 128,815

[22] Filed: Mar. 10, 1980

[30] Foreign Application Priority Data

Mar. 20, 1979 [DE] Fed. Rep. of Germany ..... 2910878

[51] Int. Cl.[3] ..... B01F 7/32

[52] U.S. Cl. ..... 366/302; 366/325

[58] Field of Search ..... 366/65, 243, 244, 256, 366/261, 276, 277, 286, 289, 295, 302, 303, 325, 329, 332, 334, 343

[56] References Cited

U.S. PATENT DOCUMENTS 1,699,916 1/1929 Platin ..... 366/302

2,115,809 5/1938 Goldman ..... 366/289

4,225,247 9/1980 Hodson ..... 366/65 X

FOREIGN PATENT DOCUMENTS 2720342 11/1978 Fed. Rep. of Germany .

*Primary Examiner*—Philip R. Coe

*Attorney, Agent, or Firm*—Cushman, Darby & Cushman

[57] ABSTRACT

A stirrer which permits homogenous and quick thorough mixing for the conditioning of bioinjurious waste, particularly radioactive waste, by means of a binder in the final storage container. The stirrer has a portion rotatable on another portion fixed in the container. The rotatable portion includes closed frame means having two or more opposite axially staggered stirrer arms secured to a hollow central bearing sleeve having axially spaced parts. The fixed portion includes a rod-like part upstanding centrally from the bottom of the container with the sleeve journalled thereon. The fixed portion is provided with one or more mixing elements secured thereto and disposed between the sleeve parts.

6 Claims, 2 Drawing Figures

APPARATUS FOR CONDITIONING BIOINJURIOUS WASTE

BACKGROUND OF THE INVENTION

The invention is directed to an apparatus for conditioning bioinjurious waste, particularly radioactive waste, such as solutions, slimes or suspensions by compulsory mixing of the pumpable waste with a binder in a final storage container by means of a disposable stirrer permanently installed in the container.

It is known to convert radioactive wastes into a solid form suitable for final storage by mixing with suitable binders, preferably cement.

A particularly good thorough mixing can be attained in intensive mixers from which the active cement pulp is drawn off into drums. The disadvantage of this principle of mixing is the drawing off process up to the final storage container. It is also known to place the dry cement directly in the final storage container, to pump in or suck in the waste and to undertake the thorough mixing in the final storage container. This method of mixing cannot be accomplished with a simple stirring process because of the high stirring power needed on the one hand and the need for homogeneous thorough mixing on the other. To overcome these difficulties there have been proposed various solutions.

In one solution to the problem the thorough mixing takes place zonally with a planet mixer through which the stirring zone changes over the entire circumference of the container. A disadvantage of this mixing principle is the possible carrying along of contamination because the total surface of the container must remain free and in the withdrawal from the container active cement pulp adheres to the stirrer. Therefore additional precautions are necessary, namely the exact adjustment of the container rim to a hot cell lying above it and the separate cleaning of the stirrer at specific intervals.

As another solution there was proposed in German OS No. 2720342 to transfer to the final storage container through suitable installations the function of a mixing drum. A disadvantage to this proposal is the need to convey the radioactive waste through a revolving turret. Furthermore in this principle of mixing there must remain a substantial amount of free space in order to continue to guarantee the homogeneity of the final mixture. Furthermore, there cannot be employed any standard containers.

With a simple, permanently installed, uniaxial stirrer which is supported and centered at the bottom of the container, evaporator concentrates and filter sludges particularly are not homogeneously cemented, since because of the deficient mixing in the region of the stirrer axis clumps form which turn with the stirrer and do not become dissolved.

Therefore it was the problem of the present invention to develop an apparatus for conditioning bioinjurious waste, particularly radioactive waste, by forced mixing of the pumpable waste with a binder in a final storage container by means of a permanently installed disposable stirrer device which safely avoids the disadvantages of the previous practice for conditioning bioinjurious waste. The mixing process should take place in known manner with a disposable stirrer in order to present a spreading of the contamination. A homogeneous final mixing and the lowest possible stirring force should be guaranteed by a suitably shaped stirrer. In order to attain high throughput the dosaging of the waste should take place in the shortest possible time and in one step. By adjusting the stirrer geometry to the container, all standard containers should be able to be employed.

SUMMARY OF THE INVENTION

The problem has been solved according to the invention by constructing the stirrer from a free, rotatable portion and a fixed portion wherein the free, rotatable portion consists of a closed frame with two or more opposite staggered stirrer arms and an interrupted, hollow middle sleeve that is guided axially through a fixed part which is provided with one or more fixed mixing elements. Likewise, there are advantageously attached mixing elements on the horizontal and inclined parts of the stirrer arms. The distance of the external parts of the rotatable stirrer portion to the container wall or to the container bottom is preferably 1 cm. It has been found particularly advantageous to place fixed mixing elements in the free space between the sleeve parts on the fixed parts. These mixing elements do not turn during the stirring process in order that the formation of non thoroughly mixed cement clumps in the center of the container are effectively suppressed. Therefore, the stirring process leads to a homogeneous final product. The frame parts preferably consist of tube and sheet material. This apparatus has the further advantage that even with the presence of higher amounts of dry cement (up to 95 vol. %), the entire liquid charge can be pumped into the final container within a few minutes without overflowing the container. The speed of penetration of the liquid waste into the dry cement and the vertical thorough mixing is additionally improved through the mixing elements placed on the arms of the rotatable stirrer part and preferably made of sheet iron. Therewith the necessary stirring force for the homogenization of the mixture remains so low that it can be placed on the drive aggregate without difficulty. Through the axial guiding of the moveable part with the rigid part, e.g., there can be taken up from a 400 liter container torques up to 375 kpm without mechnical strain. With a maximum distance of the rotatable stirrer parts to the container wall of 2 cm there are not produced non-thoroughly mixed rim zones. It is particularly advantageous that by a corresponding adjustment of the geometry of the stirrer there can be employed all standard containers for the conditioning.

An additional advantage makes possible the driving of this stirrer works with a stepless, controllable hydraulic drive. The pressure on the hydraulic drive shows a characteristic course for the principle of mixing. After a steep increase through the occurrence in the interval of a very viscous phase upon further mixing with supplied aqueous waste there is visible a drop up to a low final value. The mixture is homogeneous at constant pressure. Therewith a control of the mixing process and a saving in time is possible through earlier finishing thereof. As a result for 200 and 400 liter containers at 90–95% volume utilization there are attained stirring times of 8–12 minutes.

The apparatus of the invention will be explained in illustrative form schematically based on FIGS. 1 and 2.

DESCRIPTION OF THE PREFERRED EMBODIMENTS

Figure 1:
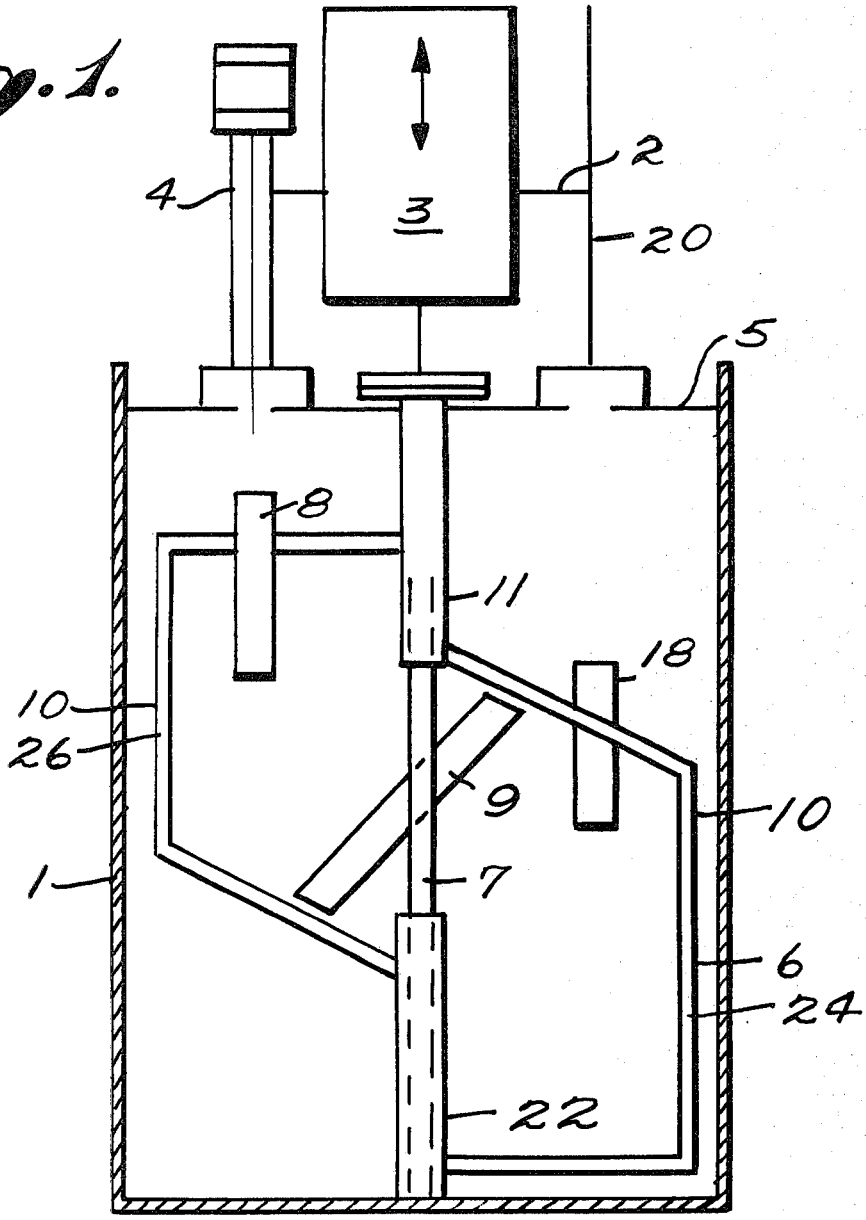
FIG. 1 shows a section of a 400 liter container in front view with the connecting lines, stirrer drive, intermediate cover and stirring mechanism.

Through lowering of a continuously vertically adjustable slide 2 there were attached to the 400 liter final storage container 1 having a dry cement present therein the stirrer drive mechanism 3, the supply gas line 4, the waste line 20, and the overflow safety mechanism at the intermediate cover 5. The stirrer consists of a freely moveable part 6 rotatable on a stationary upright rod-like part 7 having its lower end fastened to the center of a base plate at the bottom of the container. The moveable portion 6 of the stirrer consists of two or more closed frames 10 providing two or more upright stirrer arms 24 and 26 staggeredly arranged mixingly opposite each other closely adjacent the wall of the container. The frames 10 have radial arms secured to the upper and lower parts 11 and 22, respectively, of an interrupted sleeve rotatable on the rod-like part 7.

Figure 2:
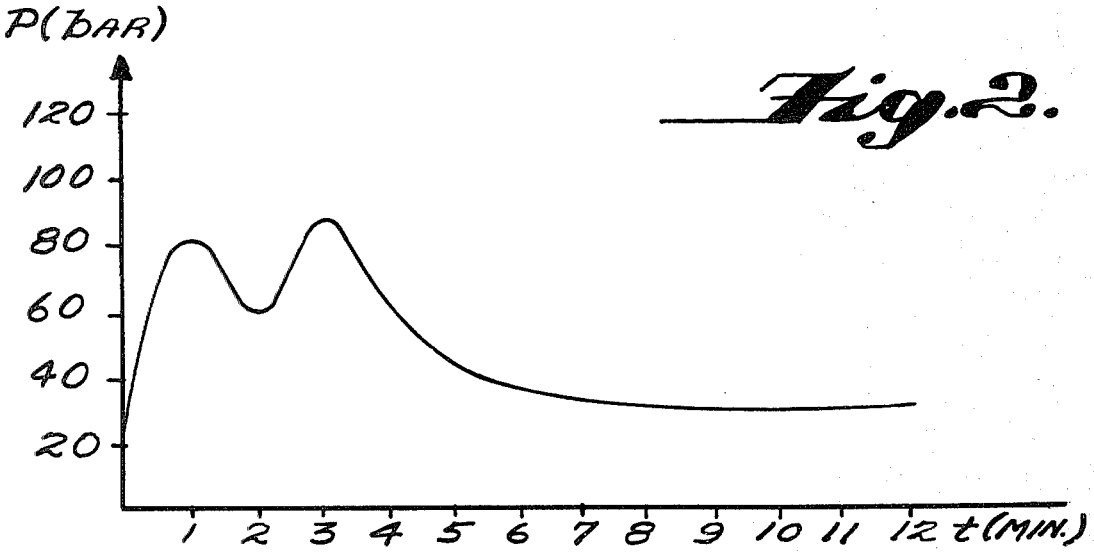
FIG. 2 is a graph of the course of the pressure on the hydraulic drive depending on the time of stirring.

To improve the vertical mixing there are fastened to the upper horizontal and inclined radial arms of the frames 10 elongated plates of sheet iron, shown at 8 and 18, respectively. The forced mixing in the center of the container 1 is effected through the solid mixing element 9, likewise preferably of sheet iron, fastened to the exposed portion of the rod-like part 7 between the upper and lower sleeve parts 11 and 22. With a rotational speed of 82 rpm of the rotatable part 6, within 3.5 minutes there were continuously pumped into the container 240 liters of a liquid waste which consisted of a kieselguhr sludge (25% dry material). The pressure/time diagram is set forth in FIG. 2. After 3 minutes there occurred a maximum pressure of 90 bar. After 8 minutes the mixing process was completed. There was obtained a homogeneous clump free final product.

What is claimed is:

1. In apparatus for conditioning bioinjurious pumpable waste, especially radioactive waste, by forced mixing with a settable binder in a final storage container having stirrer means installed therein, the improvement comprising:

said stirrer means being constructed of a rotatable portion and a portion fixed to the container, said rotatable portion comprising closed frame means providing at least two opposite stirrer arm means secured to a hollow central shaft having at least two axially spaced parts, said fixed portion comprising a rod-like part extending upright from the central portion of the bottom of the container with said hollow shaft being journalled thereon, said rod-like part being provided with at least one mixing element secured thereto at a location thereon between said shaft parts.

2. The apparatus defined in claim 1 wherein the frame means are made of tubular and sheet metal material.

3. The apparatus defined in claim 1 wherein each frame means includes a radial arm having a plate-like mixing element secured thereto.

4. The structure defined in claim 3 wherein the mixing elements are made of sheet iron.

5. The structure defined in claim 1 wherein the frame means is so dimensioned that the space between each stirrer arm means and the wall of the container is at most two centimeters.

6. The structure defined in claim 1 wherein the frame means includes a lower radial arm with the space between said arm and the bottom of the container being at most two centimeters.

* * * * *